US006644794B1

(12) United States Patent
Wilson et al.

(10) Patent No.: US 6,644,794 B1
(45) Date of Patent: Nov. 11, 2003

(54) COLLAPSIBLE INK RESERVOIR WITH A COLLAPSE RESISTING INSERT

(75) Inventors: Rhonda L. Wilson, Monmouth, OR (US); Jeffrey L. Thielman, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 196 days.

(21) Appl. No.: 09/698,899

(22) Filed: Oct. 27, 2000

(51) Int. Cl.[7] ..... B41J 2/175

(52) U.S. Cl. ..... 347/86

(58) Field of Search ..... 347/85, 86, 87, 347/7

(56) References Cited

U.S. PATENT DOCUMENTS

| | | | | | |
|---|---|---|---|---|---|
| 4,038,650 | A | | 7/1977 | Evans et al. | 340/619 |
| 4,544,840 | A | | 10/1985 | Keller | 250/227.23 |
| 4,558,326 | A | * | 12/1985 | Kimura et al. | 347/30 |
| 4,587,535 | A | | 5/1986 | Watanabe | 347/23 |
| 4,604,633 | A | | 8/1986 | Kimura et al. | 347/7 |
| 4,639,738 | A | | 1/1987 | Young et al. | 347/89 |
| 4,973,993 | A | | 11/1990 | Allen | 347/7 |
| 4,977,413 | A | | 12/1990 | Yamanaka et al. | 347/7 |
| 5,280,300 | A | * | 1/1994 | Fong et al. | 347/87 |
| 5,583,545 | A | | 12/1996 | Pawlowski, Jr. et al. | 347/7 |
| 5,583,547 | A | | 12/1996 | Gast et al. | 347/22 |
| 5,623,290 | A | | 4/1997 | Iida et al. | 347/7 |
| 5,650,811 | A | * | 7/1997 | Seccombe et al. | 347/85 |
| 5,729,256 | A | | 3/1998 | Yamanaka et al. | 347/7 |
| 5,767,882 | A | * | 6/1998 | Kaplinsky et al. | 347/87 |
| 5,877,793 | A | * | 3/1999 | Erickson | 347/85 |
| 6,053,607 | A | * | 4/2000 | Kaplinsky et al. | 347/87 |
| 6,273,563 | B1 | * | 8/2001 | Volker | 347/86 |

FOREIGN PATENT DOCUMENTS

| | | | | |
|---|---|---|---|---|
| EP | 0405555 | A2 | 1/1991 | |
| EP | 0574182 | A2 | 12/1993 | |
| EP | 0602969 | A1 | 6/1994 | B41J/2/175 |
| EP | 0840098 | A2 | 5/1998 | |
| EP | 1 203 666 | * | 5/2002 | |
| JP | 5573564 | | 6/1980 | |
| JP | 60024954 | | 2/1985 | |
| JP | 1237148 | | 9/1989 | |

* cited by examiner

*Primary Examiner*—Michael Nghiem

(57) ABSTRACT

An ink container that includes a collapsible ink reservoir containing an ink supply, and a collapse controlling insert disposed in the collapsible ink reservoir for controlling a remaining ink supply versus ink supply pressure characteristic of the collapsible ink reservoir. Also disclosed is an ink level detection system that includes a pressure transducer for sensing a pressure of the ink supply that is indicative of remaining ink.

4 Claims, 12 Drawing Sheets

PRINTER CONTROLLER: FIRMWARE MICROPROCESSOR
80
PRINTER DRIVER
CPU
MONITOR
82B
82
82A
84
100
116
INK SUPPLY STATION
114
112
50
52
66
64
62
60
SCANNING CARRIAGE
MEDIA
40
110
110A
110B
70
AIR PRESSURE SOURCE

DIFFERENTIAL PRESSURE (PSI)
2
1.8
1.6
1.4
1.2
1
.8
.6
.4
.2
0
0
50
100
150
200
250
300
REMAINING INK (CC
101a
102a

COLLAPSIBLE INK RESERVOIR WITH A COLLAPSE RESISTING INSERT

BACKGROUND OF THE INVENTION

The disclosed invention relates to ink jet printing systems that employ replaceable consumable parts including ink cartridges, and more particularly to a replaceable ink container that includes an integrated pressure sensor that provides signals utilized to detect ink level.

The art of ink jet printing is relatively well developed. Commercial products such as computer printers, graphics plotters, and facsimile machines have been implemented with ink jet technology for producing printed media. Generally, an ink jet image is formed pursuant to precise placement on a print medium of ink drops emitted by an ink drop generating device known as an ink jet printhead. Typically, an ink jet printhead is supported on a movable carriage that traverses over the surface of the print medium and is controlled to eject drops of ink at appropriate times pursuant to command of a microcomputer or other controller, wherein the timing of the application of the ink drops is intended to correspond to a pattern of pixels of the image being printed.

Some known printers make use of an ink container that is separably replaceable from the printhead. When the ink container is exhausted it is removed and replaced with a new ink container. The use of replaceable ink containers that are separate from the printhead allow users to replace the ink container without replacing the printhead. The printhead is then replaced at or near the end of printhead life, and not when the ink container is replaced.

A consideration with ink jet printing systems that employ ink containers that are separate from the printheads is the general inability to predict an out of ink condition for an ink container. In such ink jet printing systems, it is important that printing cease when an ink container is nearly empty with a small amount of stranded ink. Otherwise, printhead damage may occur as a result of firing without ink, and/or time is wasted in operating a printer without achieving a complete printed image, which is particularly time consuming in the printing of large images which often are printed in an unattended manner on expensive media.

SUMMARY OF THE INVENTION

The invention is directed to an ink container that includes a collapsible ink reservoir for containing an ink supply, and a collapse controlling insert disposed in the collapsible ink reservoir for allowing the collapsible ink reservoir to deformably resist collapse.

BRIEF DESCRIPTION OF THE DRAWINGS

The advantages and features of the disclosed invention will readily be appreciated by persons skilled in the art from the following detailed description when read in conjunction with the drawing wherein.

DETAILED DESCRIPTION OF THE DISCLOSURE

Figure 1:
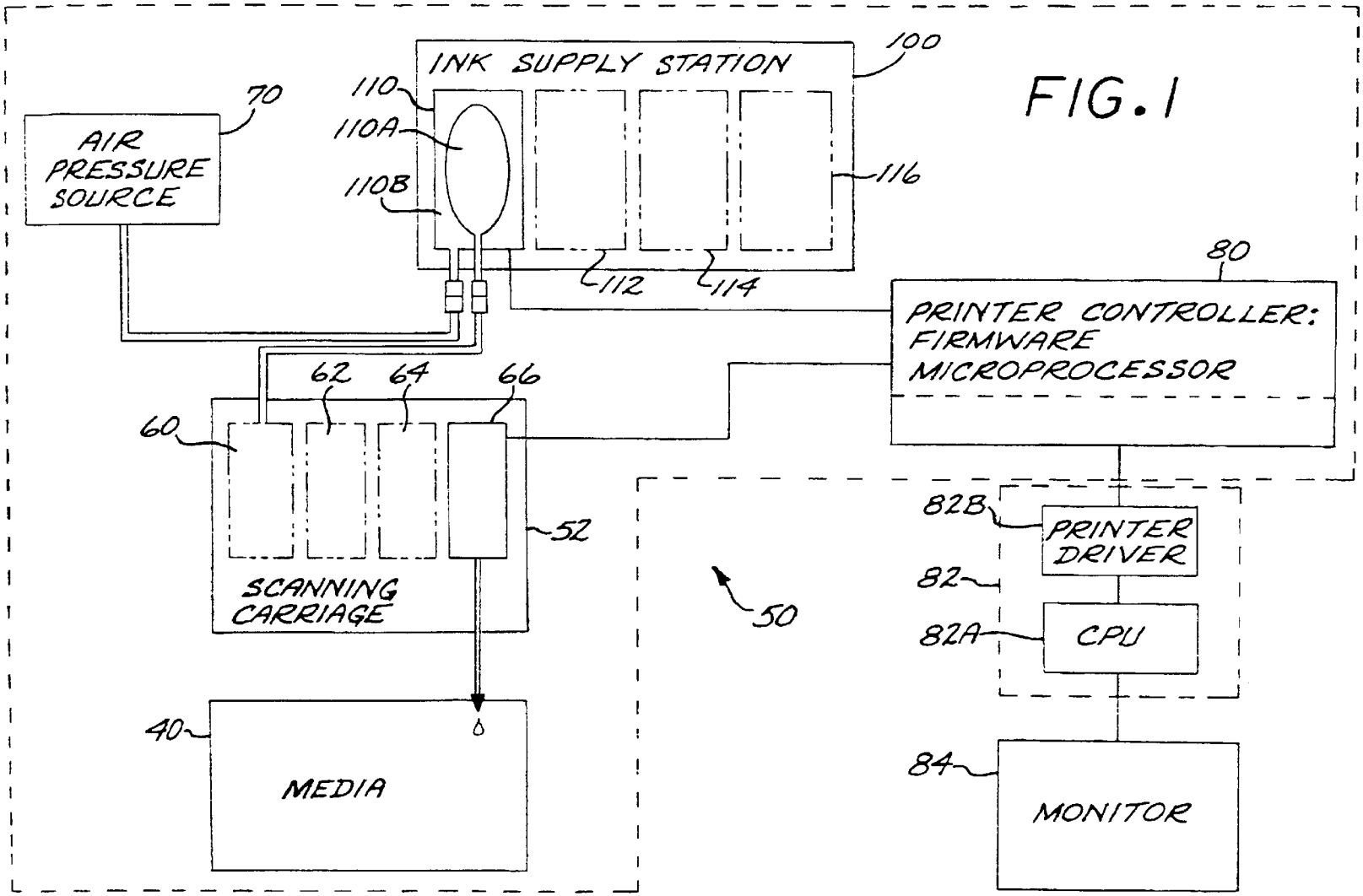
FIG. 1 is a schematic block diagram of a printer/plotter system in which an ink level sensing circuit in accordance with the invention can be employed.

In the following detailed description and in the several figures of the drawing, like elements are identified with like reference numerals.

Figure 2:
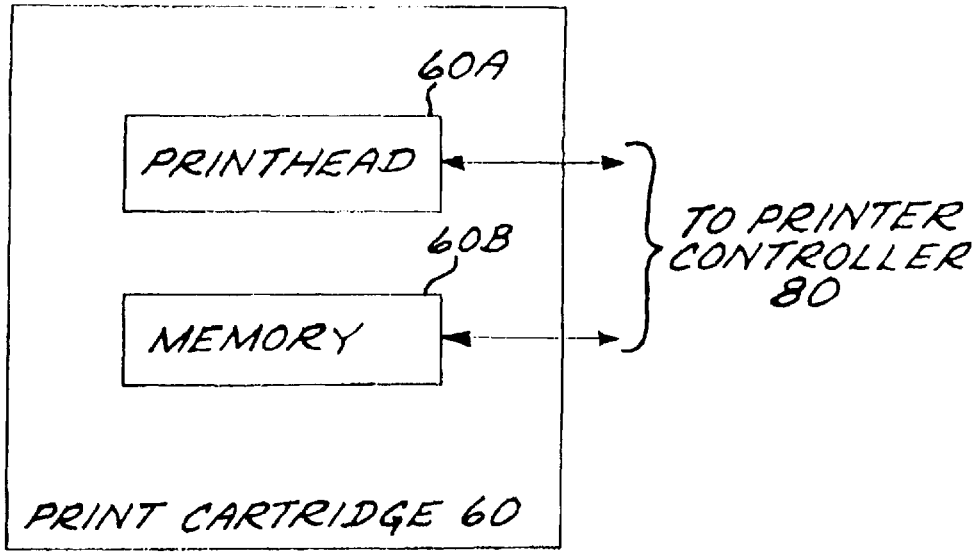
FIG. 2 is a schematic block diagram depicting major components of one of the print cartridges of the printer/plotter system of FIG. 1.

Referring now to FIG. 1, set forth therein is a schematic block diagram of a printer/plotter 50 in which the invention can be employed. A scanning print carriage 52 holds a plurality of print cartridges 60–66 which are fluidically coupled to an ink supply station 100 that supplies pressurized ink to the print cartridges 60–66. By way of illustrative example, each of the print cartridges 60–66 comprises an ink jet printhead and an integral printhead memory, as schematically depicted in FIG. 2 for the representative example of the print cartridge 60 which includes an ink jet printhead 60A and an integral printhead memory 60B. Each print cartridge has a fluidic regulator valve that opens and closes to maintain a slight negative gauge pressure in the cartridge that is optimal for printhead performance. The ink provided to each of the print cartridges 60–66 is pressurized to reduce the effects of dynamic pressure drops.

The ink supply station 100 contains receptacles or bays for accepting ink containers 110–116 which are respectively associated with and fluidically connected to respective print cartridges 60–66. Each of the ink containers 110–114 includes a collapsible ink reservoir, such as collapsible ink reservoir 110A that is surrounded by an air pressure chamber 110B. An air pressure source or pump 70 is in communication with the air pressure chamber for pressurizing the collapsible ink reservoir. For example, one pressure pump supplies pressurized air for all ink containers in the system. Pressurized ink is delivered to the print cartridges by an ink flow path that includes for example respective flexible plastic tubes connected between the ink containers 110–116 and respectively associated print cartridges 60–66.

Figure 3:
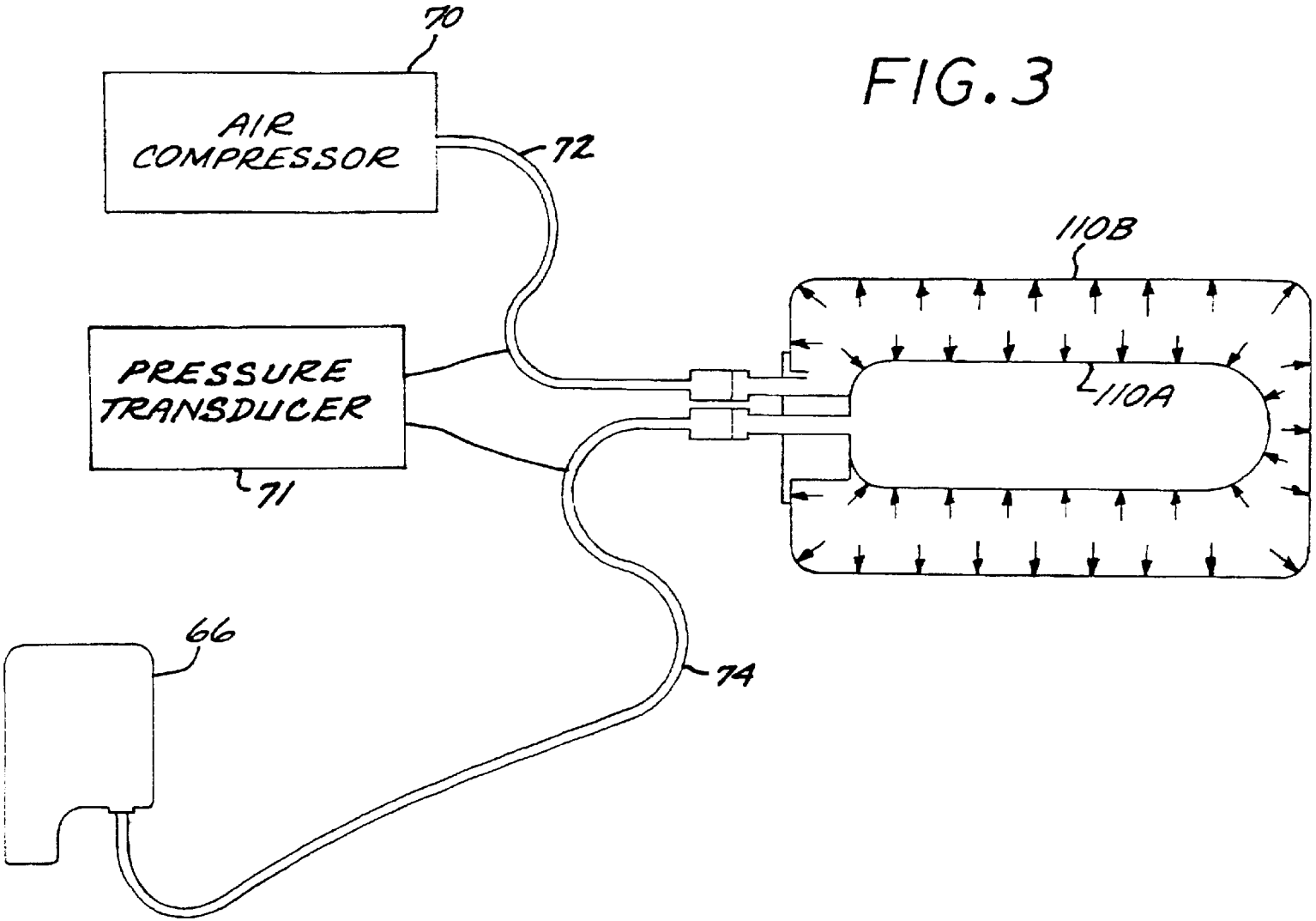
FIG. 3 is a schematic block diagram illustrating in a simplified manner the connection between an off-carriage ink container, an air pressure source, and an on-carriage print cartridge of the printer/plotter system of FIG. 1.

FIG. 3 is a simplified diagrammatic view illustrating the pressure source 70, an air pressure line 72 that delivers pressurizing gas to the pressure chamber 110B which pressurizes the collapsible ink reservoir 110*a* so as to cause ink to be delivered to the printhead cartridge via an ink supply line 74. A pressure transducer 71 is provided for detecting a pressure differential between air that is pressurizing the collapsible ink reservoir 110*a* and a pressure indicative of pressure in the collapsible ink reservoir 110*a*. For example, the pressure transducer 71 is in communication with the ink supply line 74 and the air pressure line 72. Alternatively, the pressure transducer 71 is disposed in the pressure chamber 110B, as illustrated in FIGS. 11–15, and senses an ink pressure in the collapsible ink reservoir 110*a* and a pressure in the pressure chamber 110B. As a further alternative, the pressure transducer 71 is an absolute pressure sensor that senses absolute pressure of ink in the ink supply line 74 or in the collapsible ink reservoir 110*a*.

Figure 4:
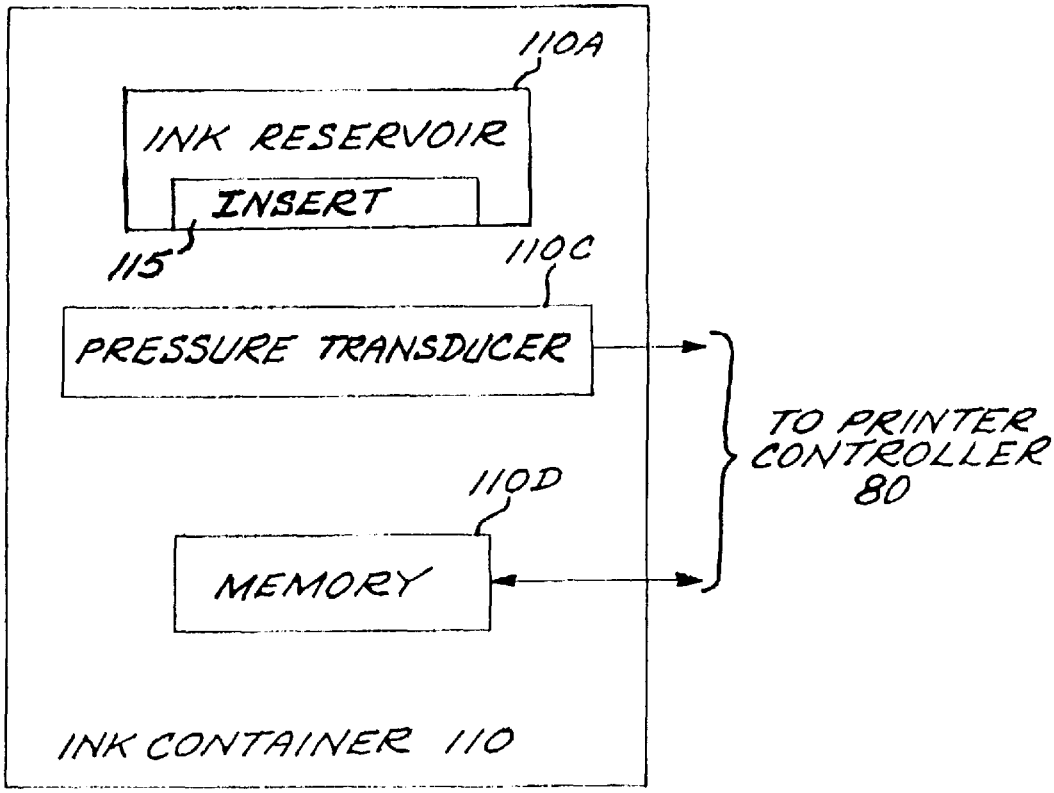
FIG. 4 is a schematic block diagram depicting major components of one of the ink containers of the printer/plotter system of FIG. 1.

Each of the ink containers includes a collapsible ink reservoir, an optional integral ink cartridge memory, and a collapse controlling insert in the collapsible ink reservoir that allows the collapsible ink reservoir to deformably resist collapse, as schematically depicted in FIG. 4 for the representative example of the ink container 110 that more particularly includes an ink reservoir 110A, an integral ink cartridge memory 110D, an optional pressure transducer 110C and a collapse controlling insert 115.

Continuing to refer to FIG. 1, the scanning print carriage 52, the print cartridges 60–66, and the ink containers 110–114 are electrically interconnected to a printer microprocessor controller 80 that includes printer electronics and firmware for the control of various printer functions, including for example analog-to-digital converter circuitry for converting the outputs of the ink level sensing pressure transducers 71 associated with the ink containers 110–116. The controller 80 thus controls the scan carriage drive system and the printheads on the print carriage to selectively energize the printheads, to cause ink droplets to be ejected in a controlled fashion on the print medium 40. The printer controller 80 further detects a low level of remaining ink volume in each of the ink containers 110–114 pursuant to the output of the associated pressure transducer 71.

A host processor 82, which includes a CPU 82A and a software printer driver 82B, is connected to the printer controller 82. For example, the host processor 82 comprises a personal computer that is external to the printer 50. A monitor 84 is connected to the host processor 82 and is used to display various messages that are indicative of the state of the ink jet printer. Alternatively, the printer can be configured for standalone or networked operation wherein messages are displayed on a front panel of the printer.

Figure 5:
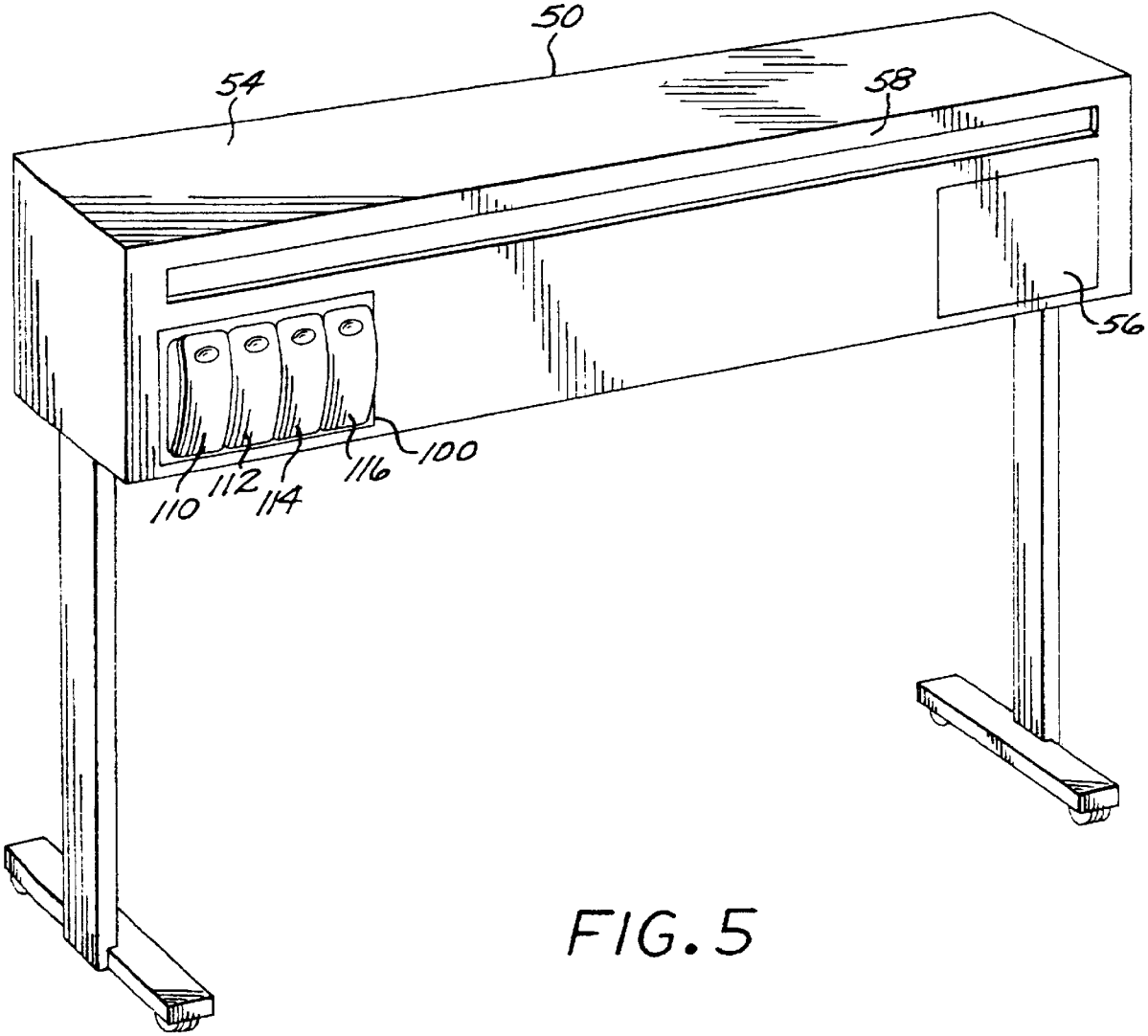
FIG. 5 a simplified isometric view of an implementation of the printer/plotter system of FIG. 1.

FIG. 5 shows in isometric view an exemplary form of a large format printer/plotter in which the invention can be employed, wherein four off-carriage (or off-axis) ink containers 110, 112, 114, 116 are shown installed in an ink supply station. The printer/plotter of FIG. 5 further includes a housing 54, a front control panel 56 which provides user control switches, and a media output slot 58. While this exemplary printer/plotter is fed from a media roll, it should be appreciated that alternative sheet feed mechanisms can also be used.

Referring now to FIGS. 6–9, 10A, 10B and 11–15, schematically illustrated therein is a specific implementation of an ink container 200 which employs a collapse controlling insert 115 in accordance with the invention that provides for deforming resistance to collapse of a collapsible ink reservoir, and which can be implemented as each of the ink containers 110–116 that are structurally substantially identical.

Figure 6:
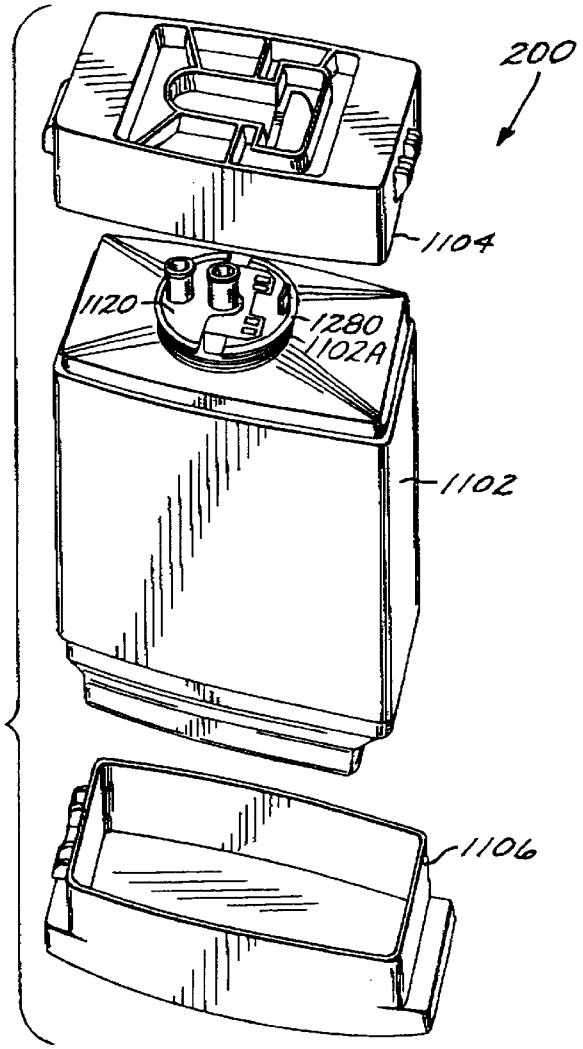
FIG. 6 is a schematic isometric exploded view illustrating the major components of an implementation of one of the ink containers of the printer/plotter system of FIG. 1.
Figure 7:
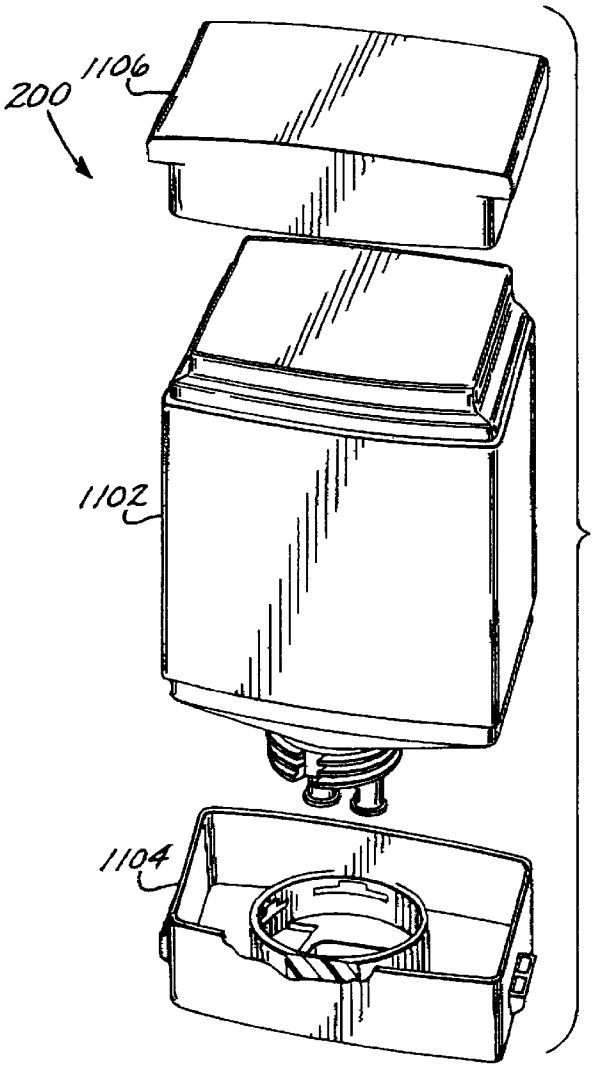
FIG. 7 is a further schematic isometric exploded view illustrating the major components of an implementation of one of the ink containers of the printer/plotter system of FIG. 1.

As shown in FIGS. 6–7, the ink container 200 generally includes an outer container or pressure vessel 1102, a chassis member 1120 attached to a neck region 1102A at a leading end of the pressure vessel 1102, a leading end cap 1104 attached to the leading end of the pressure vessel, and a trailing end cap 1106 attached to the trailing end of the pressure vessel 1102.

Figure 8:
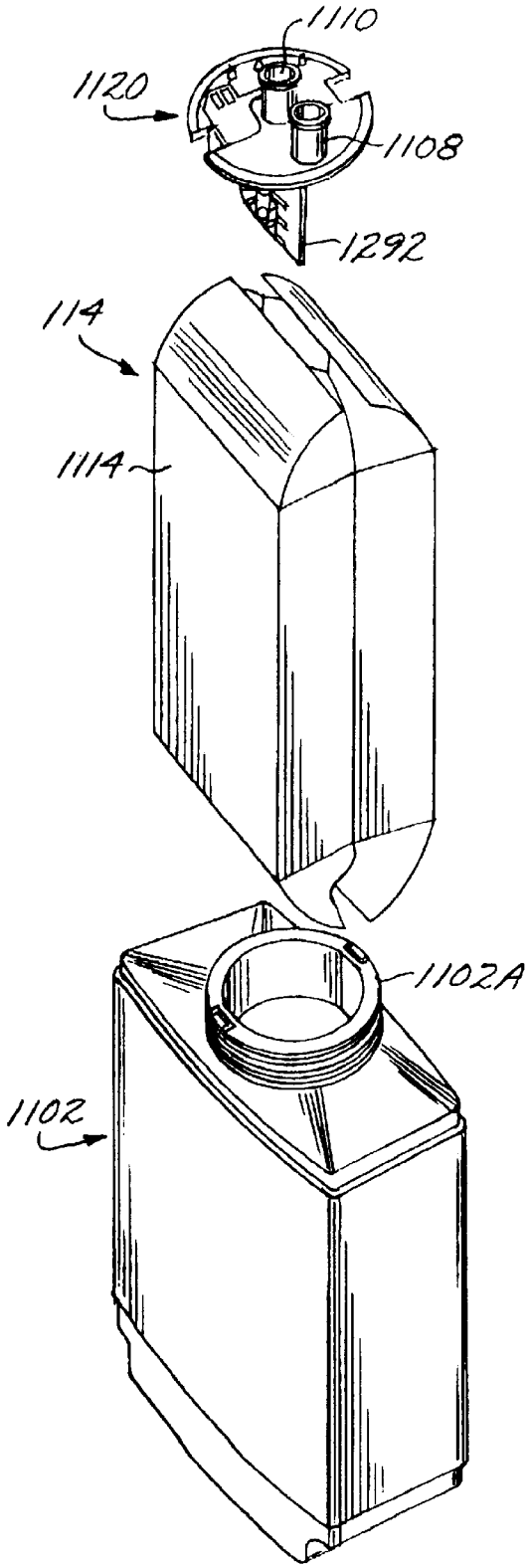
FIG. 8 is an exploded isometric view showing the pressure vessel, collapsible ink reservoir, and chassis member of the ink container of FIGS. 6 and 7.
Figure 9:
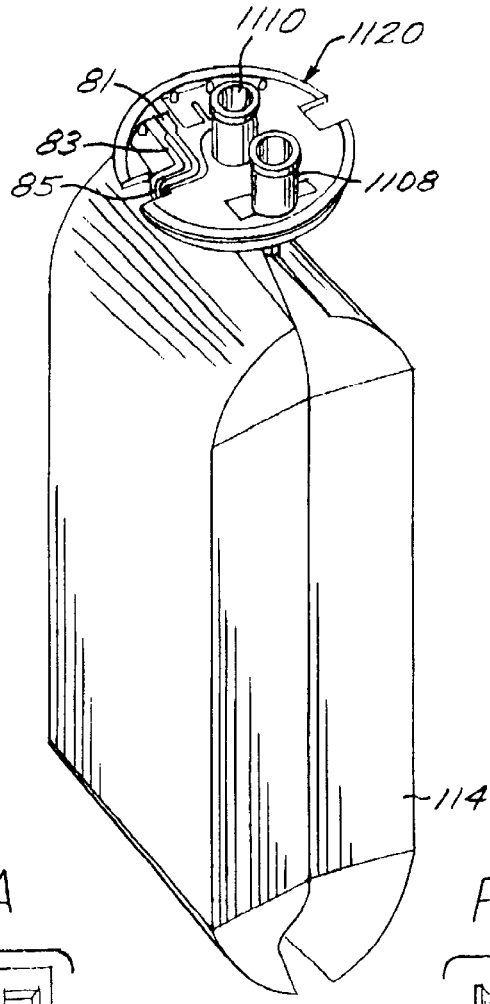
FIG. 9 is a schematic isometric view illustrating the collapsible ink reservoir and chassis member of the ink container of FIGS. 6 and 7.
Figure 11:
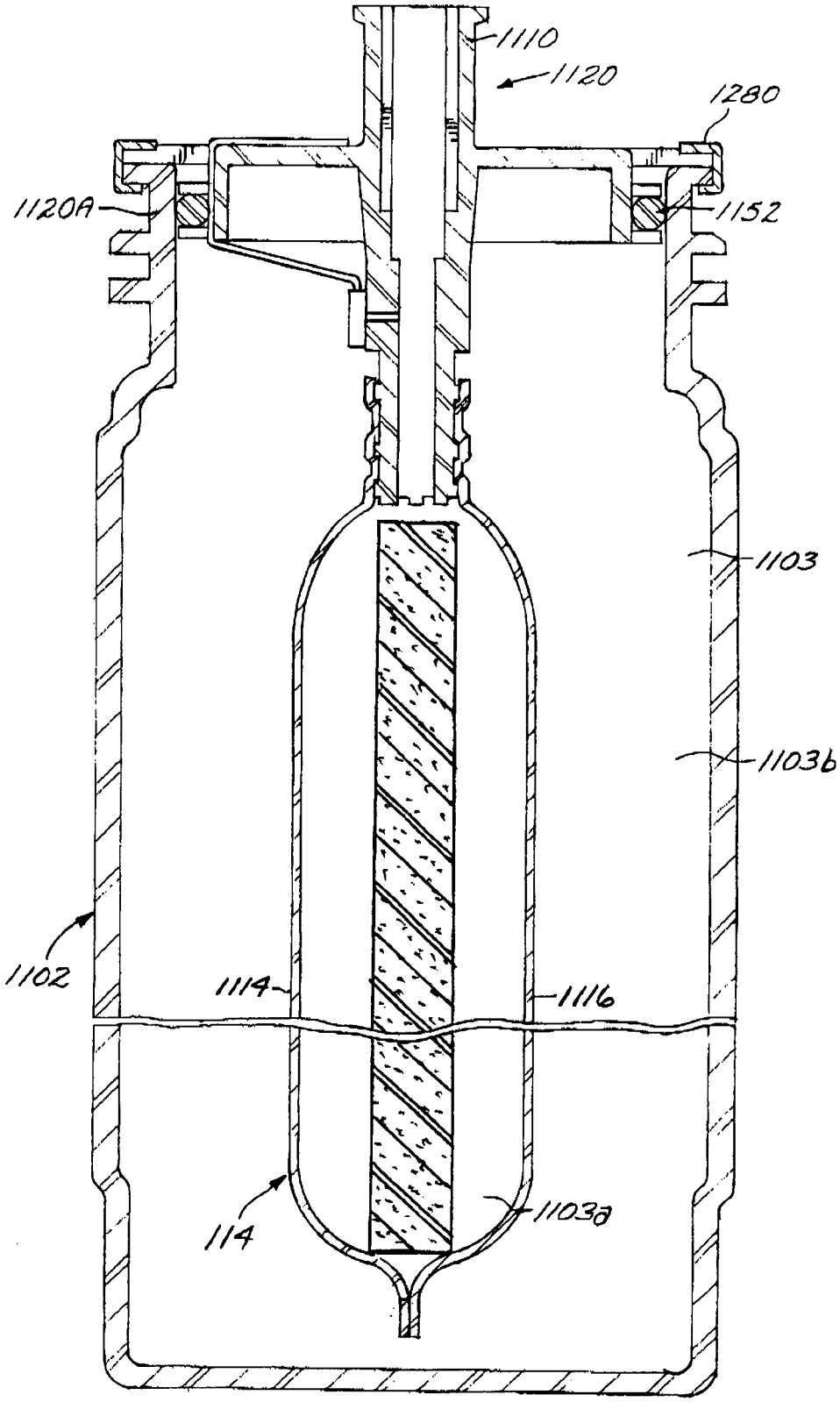
FIG. 11 is a cross-sectional view of a pressure transducer disposed in the ink container of FIGS. 6 and 7.
Figure 12:
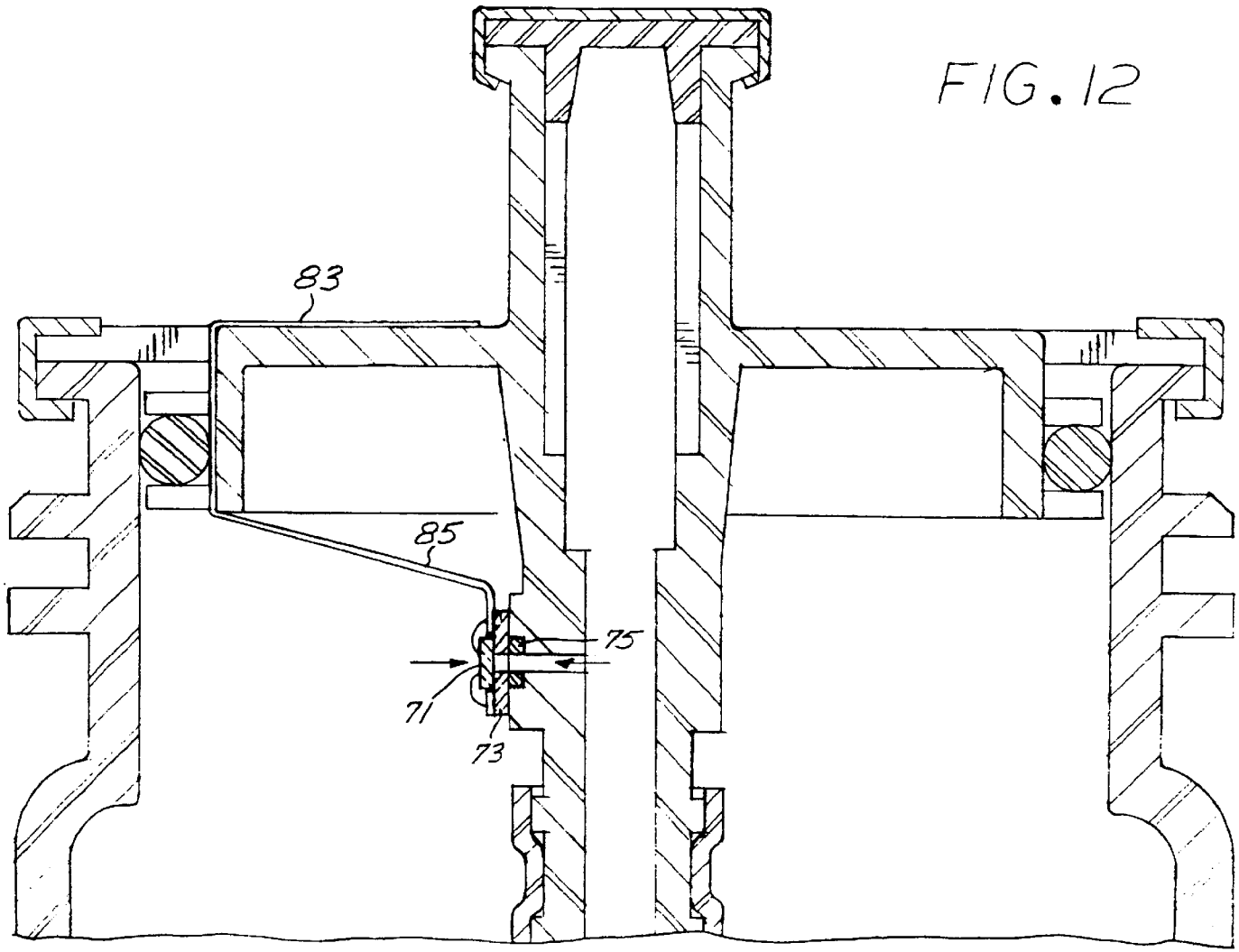
FIG. 12 is a cross sectional view illustrating the attachment of the pressure transducer to the chassis member of the ink container of FIGS. 6 and 7.
Figure 13:
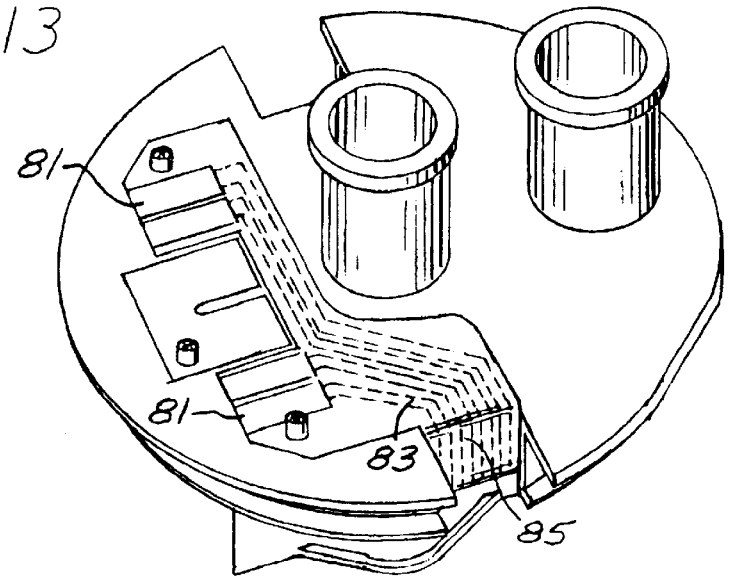
FIG. 13 is an isometric view illustrating electrical contacts disposed on the top portion of the chassis member of the ink container of FIGS. 6 and 7.
Figure 14:
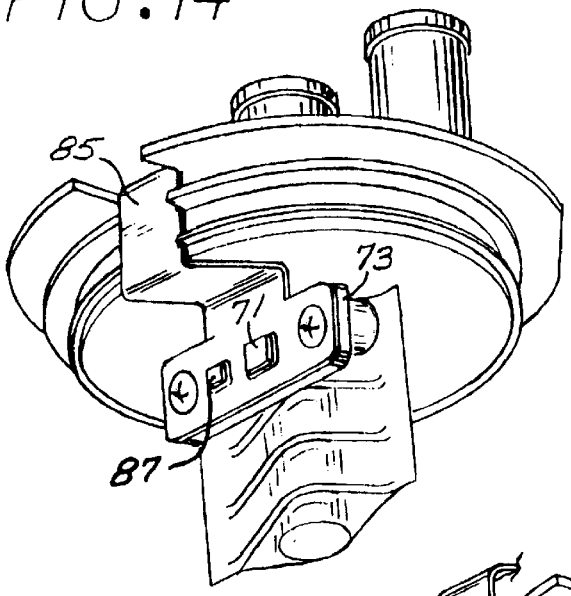
FIG. 14 is an isometric view illustrating the attachment of the pressure transducer to the chassis member of the ink container of FIGS. 6 and 7.
Figure 15:
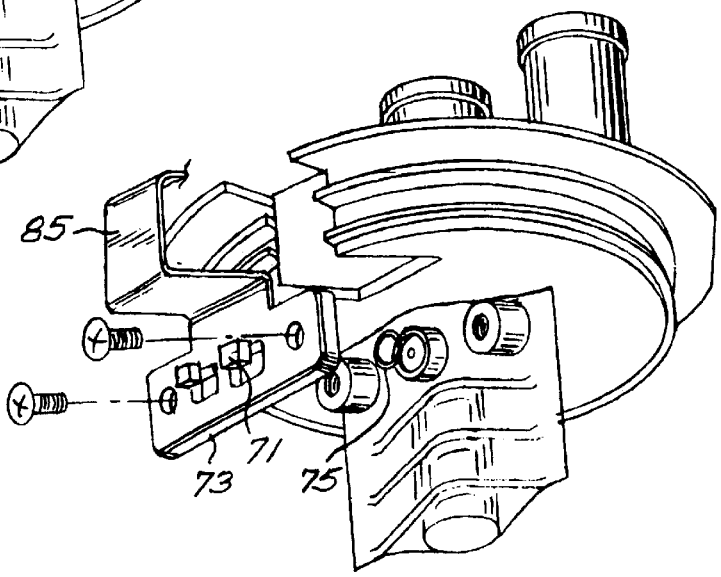
FIG. 15 is an exploded view illustrating the pressure transducer and the chassis member of the ink container of FIGS. 6 and 7.

As more particularly shown in FIGS. 8–9 and 11, the ink container 200 further includes a collapsible ink bag or reservoir 114 disposed in an interior chamber 1103 defined by the pressure vessel 1102 and sealingly attached to a keel portion 1292 of the chassis 1120 which seals the interior of the pressure vessel 1102 from outside atmosphere while providing for an air inlet 1108 to the interior of the pressure vessel 1102, and an ink outlet port 1110 for ink contained in the ink reservoir 114. In accordance with the invention, a collapse resisting or controlling insert 115 is disposed in the collapsible reservoir 114 to control the differential pressure versus ink level characteristic of the ink delivery system.

More particularly, the collapse controlling insert 115 allows the collapsible reservoir 114 to deformably resist collapse when the reservoir 114 has collapsed to the state where the collapsible reservoir walls are pressing against the insert 115. The collapsible ink reservoir 114 and the insert 115 disposed therein effectively act like a spring that deformably resists the external pressure on the collapsible ink reservoir.

When the collapsible reservoir 114 is resisting collapse, the difference between the pressure outside the collapsible ink reservoir 114 and the pressure inside the collapsible ink reservoir 114 starts to increase at a remaining ink level that is greater than the remaining ink level at which such difference would start to increase without the insert. In other words, the collapse resisting insert configures an ink supply pressure versus remaining characteristic of the collapsible ink reservoir so that remaining ink is reliably detected at a remaining ink level that is greater than a level that would be reliably detected without the insert. In this manner, remaining ink level is reliably detected earlier in the ink supply life, so that a low ink supply condition is detected before the ink supply is critically low.

The insert 115 can comprise a compliant element that deforms as the collapsible ink reservoir collapses, or it can be a non-compliant element that causes the collapsible ink reservoir to deformably resist the external pressure as it collapses to conform to the shape of the insert. Depending upon the deformability of a compliant insert, the collapsible bag can also deform as it collapses against a compliant insert.

Figure 10A:
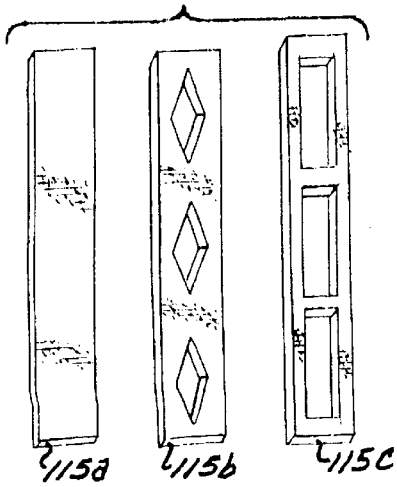
FIG. 10A schematically illustrates exemplary inserts of the ink container of FIGS. 6 and 7.

By way of illustrative examples, the collapse controlling insert comprises a foam panel 115*a*, a foam panel 115*b* having diamond shaped cut-outs, or a foam panel 115*c* having rectangular cut-outs, all as shown in FIG. 10A, and which can comprise polyurethane. The cut-outs facilitate more complete drainage of ink from the collapsible ink reservoir 114.

Figure 10B:
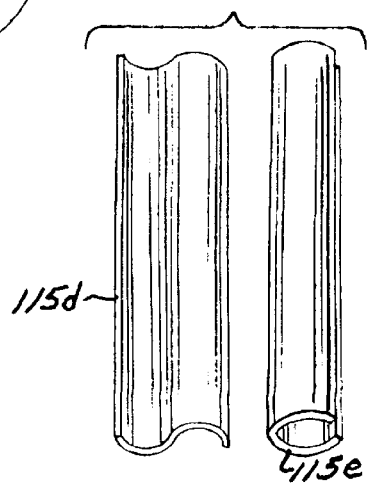
FIG. 10B schematically illustrates further exemplary inserts of the ink container of FIGS. 6 and 7.

By way of further illustrative examples, the collapse controlling insert comprises a compliant or non-compliant three-dimensional formed sheet, such as a wave-shaped element 115*d* or a C-shaped element 115*e* as shown in FIG. 10B. A compliant three-dimensional formed sheet acts like a three-dimensional spring, while a non-compliant three-dimensional formed sheet causes the stiffness of the collapsible ink reservoir to deformably resist the external pressure on the collapsible ink reservoir. The three-dimensional formed sheet can made of a plastic such as polyethylene or polypropylene, or very thin stainless steel, for example.

The chassis 1120 is secured to the opening of the neck region 1102A of the pressure vessel 1102, for example by an annular crimp ring 1280 that engages a top flange of the pressure vessel and an abutting flange of the chassis member. A pressure sealing O-ring 1152 suitably captured in a circumferential groove on the chassis 1120 engages the inside surface of the neck region 1102A of the pressure vessel 1102.

The collapsible ink reservoir 114 more particularly comprises a pleated bag having opposing walls or sides 1114, 1116. In an exemplary construction, an elongated sheet of bag material is folded such that opposed lateral edges of the sheet overlap or are brought together, forming an elongated cylinder. The lateral edges are sealed together, and pleats are in the resulting structure generally in alignment with the seal of the lateral edges. The bottom or non-feed end of the bag is formed by heat sealing the pleated structure along a seam transverse to the seal of the lateral edges. The top or feed end of the ink reservoir is formed similarly while leaving an opening for the bag to be sealingly attached to the keel portion 1292 of the chassis 1120. By way of specific example, the ink reservoir bag is sealingly attached to keel portion 1292 by heat staking.

The collapsible ink reservoir 114 thus defines an occupied portion 1103*a* of the interior chamber 1103, such that an unoccupied portion 1103*b* of the interior chamber 1103 is formed between the pressure vessel 1102 and the collapsible ink reservoir 114. The air inlet 1108 is the only flow path into or out of the unoccupied portion 1103*b* which functions as an air pressure chamber, and more particularly comprises a fluid conveying conduit that is in communication with the unoccupied portion 1103*b* of the interior chamber 1103. The ink outlet port 1110 is the only flow path into or out of the occupied portion 1103*a* and comprises a fluid conveying conduit that is in communication with the occupied portion 1103*a* of the interior chamber 1103, namely the interior of the collapsible ink reservoir 114. The ink outlet port 1110 is conveniently integrated with the keel portion 1292 of the chassis 1120.

As more specifically shown in FIGS. 11–15, the pressure transducer 71 can be disposed in the interior chamber 1103 so as to detect a difference between a pressure of the unoccupied portion 1103*b* of the interior chamber 1103 and a pressure of ink in the collapsible ink reservoir 114 (i.e., a differential pressure), or an absolute pressure of ink in the collapsible ink reservoir 114. By way of illustrative example, the pressure transducer 71 is mounted on a ceramic substrate 73 to form a transducer subassembly that is attached to an outside wall of the output port 1110. A bore or opening in the wall of the output port 1110 and a bore or opening in the substrate 73 expose the pressure transducer to pressure in the output port 1110. Appropriate sealing including an O-ring 75 is provided to prevent leakage between the interior of the outlet port 1110 and the unoccupied portion 1103*b* of the interior chamber 1103. The pressure transducer 71 is very close to the ink supply in the collapsible ink reservoir 114 so as to avoid dynamic losses between the ink supply and the point of pressure measurement, and thus the pressure transducer 71 is effectively exposed to the pressure in the collapsible ink reservoir 114.

The electrical output of the pressure transducer 71 is provided to externally accessible contact pads 81 disposed on the top of the chassis 1120 via conductive leads 83 of a flexible printed circuit substrate 85 that extends between the ceramic substrate and the top of the chassis 1120, passing on the outside surface of the chassis 1120 between the O-ring 1152 and such outside surface. The conductive leads 83 are electrically connected to the externally accessible contact pads 81 disposed on the top of the chassis which can be formed on one end of the flexible printed circuit substrate 85 that would be attached to the top of the chassis 1120. The output of the pressure transducer 71 can be sampled while printing which avoids the need to interrupt printing to take a reading.

Optionally, a memory chip package 87 can be conveniently mounted on the ceramic substrate 87 and interconnected to associated externally accessible contact pads by associated conductive leads 83 of the flexible printed circuit substrate 85.

Figure 16:
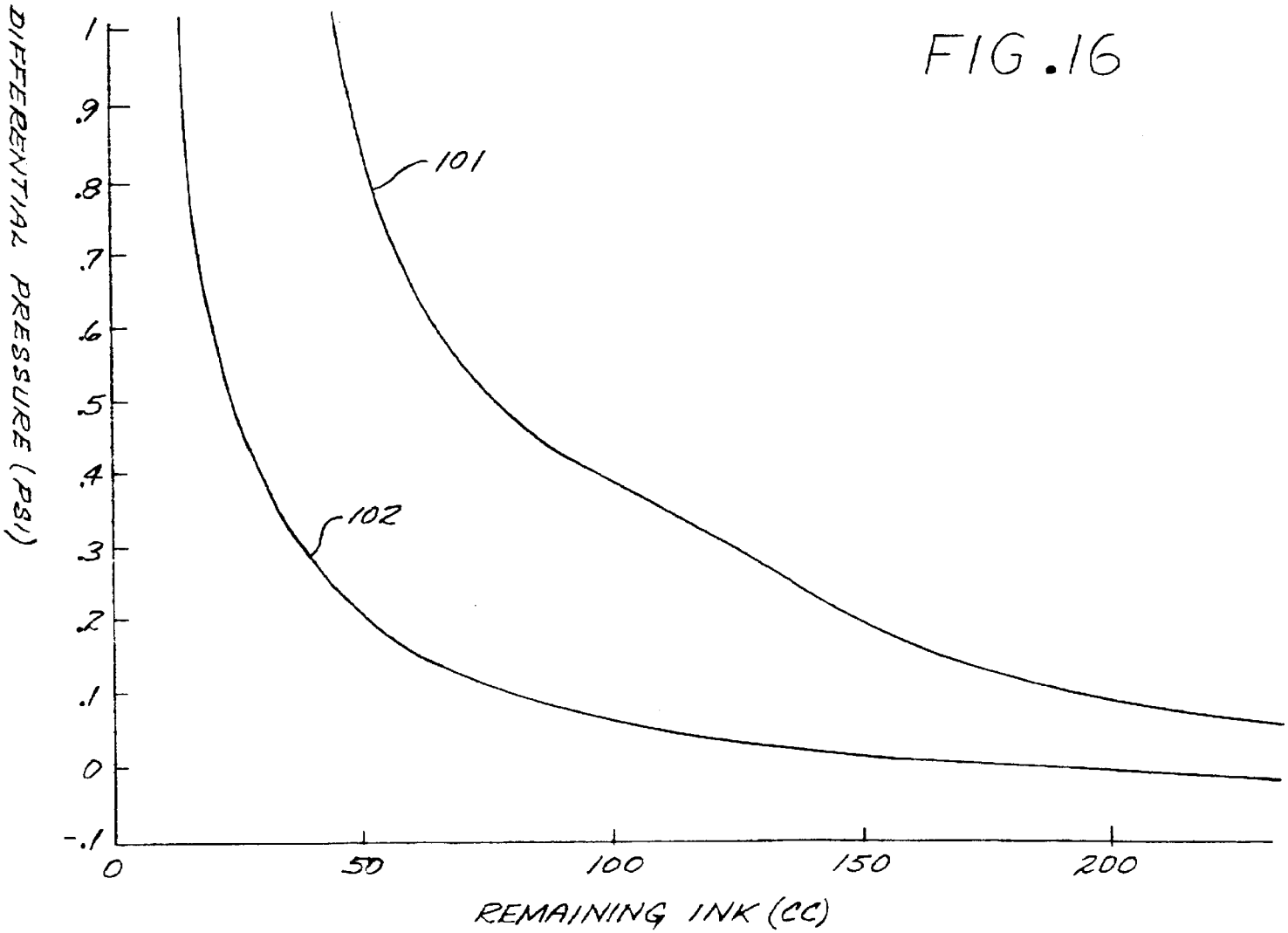
FIG. 16 is a graph of a schematic representative differential pressure versus remaining ink characteristic for a system that employs a collapsible ink reservoir having a compliant insert in accordance with the invention, and a schematic representative differential pressure versus remaining ink characteristic for a system that employs the same or similar collapsible ink reservoir but without a compliant insert.
Figure 17:
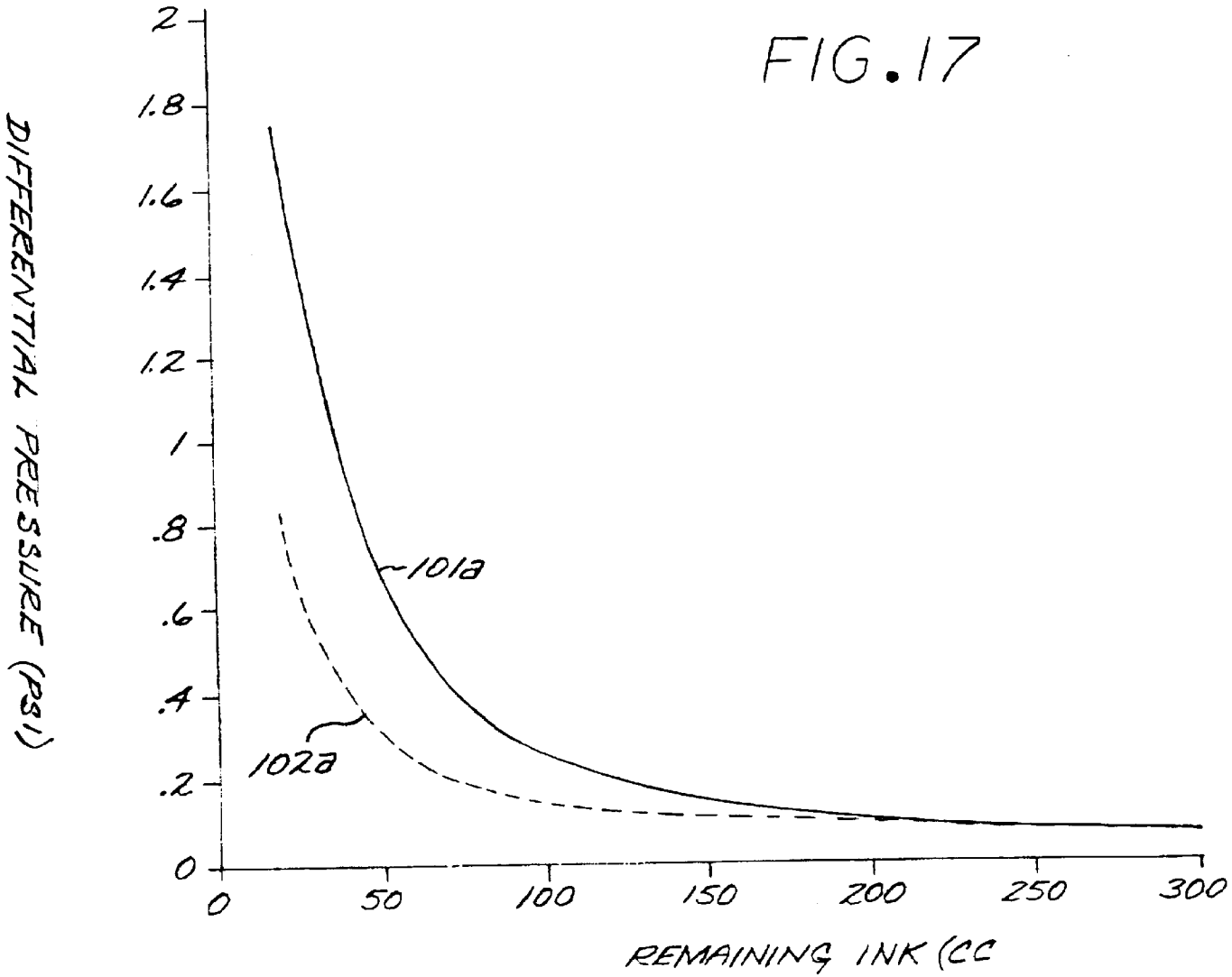
FIG. 17 is a graph of a schematic representative differential pressure versus remaining ink characteristic for a system that employs a collapsible ink reservoir having an inflexible insert in accordance with the invention, and a schematic representative differential pressure versus remaining ink characteristic for a system that employs the same or similar collapsible ink reservoir but without an inflexible insert.

In regard to detecting a low ink level, the control of the pressure versus remaining ink characteristic provided by use of the collapse controlling insert 115 can be more particularly understood by reference to FIGS. 16 and 17. FIG. 16 sets forth a schematic representative ink supply differential pressure versus remaining ink characteristic 101 for a system that employs a collapsible ink bag having a collapse controlling compliant foam insert in accordance with the invention, and a schematic representative ink supply differential pressure versus remaining ink characteristic 102 for a system that employs the same or similar collapsible ink bag but without a compliant foam insert. FIG. 17 sets forth a schematic representative ink supply differential pressure versus remaining ink characteristic 101*a* for a system that employs a collapsible ink bag having a rigid wave-shaped insert in accordance with the invention, and a schematic representative ink supply differential pressure versus remaining ink characteristic 102*a* for a system that employs the same or similar collapsible ink bag but without a rigid wave-shaped collapse controlling insert.

The pressure of the ink supply (for example as detected via the ink supply line) remains approximately equal to the pressure of the pressurizing gas (for example in the pressure line) for much of the ink supply life, and thus the differential pressure is approximately zero for much of the ink supply life. As the ink supply approaches an empty condition, the pressure of the ink supply decreases with decreasing remaining ink, whereby the differential pressure increases with decreasing ink. Use of the insert causes the ink supply differential pressure to start to increase at a remaining ink level that is greater than the level at which the ink supply differential pressure would start to increase without an insert, which can used to detect an impending low ink level condition when the remaining ink is not yet critically low, which in turn can be used to provide an earlier warning to the user that allows for convenient replacement of the ink container. In other words, the insert allows for reliable detection of ink level earlier in the ink supply life, and thus increases the ink level range over which a low ink level threshold can be selected, wherein a low ink level warning is provided when the ink level decreases below such low ink level threshold as indicated by the differential pressure signal increasing above a selected pressure threshold. For example, if the low ink level is selected to be earlier in the life of the ink supply, the user can print additional output before replacing the ink container. The relationship between differential pressure and the amount of ink remaining is reasonably consistent for any given system and can be reliably characterized, and the insert is configured to select the onset of a reliable pressure signal.

It should be appreciated that the insert effectively provides for control of the ink supply pressure versus remaining ink characteristic wherein supply pressure would decrease when it starts to change, and that a low ink level warning is provided when the supply pressure decreases below a selected supply pressure threshold that is indicative of a low ink level threshold. The insert increases the ink level range over which a low ink level threshold can be selected, wherein a low ink level warning is provided when the ink level decreases below such low ink level threshold as indicated by the supply pressure decreasing below a selected supply pressure threshold.

While the foregoing implementation applies greater than ambient pressure to the ink supply, the invention can be employed in systems wherein the ink supply is subjected only to ambient or atmospheric pressure instead of a pressure that is greater than atmospheric pressure, for example in a system wherein a non-pressurized ink supply is elevated so that ink flows out of the ink container by gravity. Also, the disclosed invention can be employed in other printing or marking systems that employ liquid ink such as liquid electrophotographic printing systems.

Although the foregoing has been a description and illustration of specific embodiments of the invention, various modifications and changes thereto can be made by persons skilled in the art without departing from the scope and spirit of the invention as defined by the following claims.

What is claimed is:

1. An ink container, comprising:

a collapsible ink reservoir for containing a supply of ink;

an outer container for enclosing said collapsible ink reservoir and configured to receive pressurizing gas that pressurizes said supply of ink;

an insert structure disposed in said collapsible ink reservoir for allowing said collapsible ink reservoir to resist collapse of said collapsible ink reservoir, whereby resistance to collapse controls an ink supply pressure versus remaining ink characteristic of said collapsible ink reservoir, said insert comprising a three-dimensional formed sheet;

and wherein said formed sheet comprises plastic.

2. An ink container, comprising:

a collapsible ink reservoir for containing a supply of ink;

an outer container for enclosing said collapsible ink reservoir;

an insert structure disposed in said collapsible ink reservoir for allowing said collapsible ink reservoir to resist collapse of said collapsible ink reservoir, whereby resistance to collapse controls a pressure versus remaining ink characteristic of said collapsible ink reservoir;

wherein said insert structure determines an amount of remaining ink at which said pressure starts to change, said insert comprising a three-dimensional formed sheet;

and wherein said formed sheet comprises plastic.

3. An ink container, comprising:

a collapsible ink reservoir for containing a supply of ink;

an outer container for enclosing said collapsible ink reservoir;

an insert structure disposed in said collapsible ink reservoir for allowing said collapsible ink reservoir to resist collapse of said collapsible ink reservoir, whereby resistance to collapse controls a pressure versus remaining ink characteristic of said collapsible ink reservoir;

wherein said pressure starts to change at an amount of remaining ink that is greater than an amount of remaining ink at which said pressure would change if sail collapsible ink reservoir did not include said insert; and wherein said insert compromises a three-dimensional formed sheet, and wherein said formed sheet comprises plastic.

4. A printing apparatus, comprising:

a collapsible ink reservoir for containing supply of ink;

an outer container defining an interior chamber and enclosing said collapsible ink reservoir, said collapsible ink reservoir defining an unoccupied portion of said interior chamber that is external of said collapsible ink reservoir;

said outer container configured to receive pressurizing gas that pressurizes said supply of ink;

a pressure transducer located inside said outer container for providing an ink supply pressure signal indicative of an amount of ink remaining in said collapsible ink reservoir;

an insert structure disposed in said collapsible ink reservoir for controlling an ink supply pressure signal versus remaining ink characteristic of said collapsible ink reservoir; and wherein said insert comprises a three-dimensional formed sheet, said formed sheet comprising plastic.

* * * * *

UNITED STATES PATENT AND TRADEMARK OFFICE

CERTIFICATE OF CORRECTION

PATENT NO. : 6,644,794 B1
DATED : November 11, 2003
INVENTOR(S) : Wilson et al.

It is certified that error appears in the above-identified patent and that said Letters Patent is hereby corrected as shown below:

Column 8,
Line 35, delete “sail” and insert in lieu thereof -- said --.

Signed and Sealed this

Tenth Day of August, 2004

JON W. DUDAS
*Acting Director of the United States Patent and Trademark Office*